US006837405B2

(12) United States Patent
Rainey et al.

(10) Patent No.: US 6,837,405 B2
(45) Date of Patent: Jan. 4, 2005

(54) OVALOID BOTTLE WITH OVERCAP

(75) Inventors: Dean Rainey, Clinton, CT (US); Raymond Michael Flaig, Stamford, CT (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 138 days.

(21) Appl. No.: 10/348,521

(22) Filed: Jan. 21, 2003

(65) Prior Publication Data

US 2004/0140329 A1 Jul. 22, 2004

(51) Int. Cl.[7] ..... B65D 47/00
(52) U.S. Cl. ..... 222/546; 222/212; 222/554; 222/563
(58) Field of Search ..... 222/206, 212, 222/546, 549, 552, 554, 555, 563

(56) References Cited

U.S. PATENT DOCUMENTS 3,342,379 A * 9/1967 Foley ..... 222/173
D399,754 S 10/1998 Bertolini et al.
D404,295 S 1/1999 Bertolini et al.
5,996,850 A * 12/1999 Morali et al. ..... 222/173

FOREIGN PATENT DOCUMENTS

| | | |
|---|---|---|
| DE | 87 10 784 | 8/1987 |
| GB | 1 414 957 | 11/1975 |
| NL | 7216573 | 6/1974 |

OTHER PUBLICATIONS

International Search Report.

* cited by examiner

*Primary Examiner*—Gene Mancene
*Assistant Examiner*—Patrick Buechner
(74) *Attorney, Agent, or Firm*—Milton L. Honig

(57) ABSTRACT

A dispensing container is provided which includes an ovaloid bottle and an ovaloid overcap. The bottle includes a dispensing aperture. The overcap is formed with a roof at a closed end thereof and a surrounding wall with a mouth defining an open end opposite the closed end. A pintel and a circular collar both project from the roof in a direction toward the open end. The pintel is sealingly fittable into the dispensing aperture. The circular collar ensures that the pintel will not misalign with the aperture of the bottle and thereby avoids damage to the soft plastic of the pintel. The bottle has a shoulder which serves as a camming device for easy removal of the overcap in a twist motion.

9 Claims, 3 Drawing Sheets

OVALOID BOTTLE WITH OVERCAP

BACKGROUND OF THE INVENTION

1. Field of the Invention

The invention relates to an ovaloid bottle with overcap for storage and dispensing of liquids.

2. The Related Art

Unusual designs engender engineering challenges. Round bottles are relatively easy to engineer with respect to their closures. By contrast, the asymmetry of a non-circular shape presents difficulty in creating a fluid-tight closure.

Flip-top caps have been used for oval bottles. For instance, U.S. Pat. No. Des. 399,754 (Bertolini et al.) describes an ovaloid flip-top cap attached by hinge to the roof of an ovaloid bottle. However, two piece construction is quite rare where the cap is totally separate from the bottle. Sometimes the aesthetics of a particular design require a cap separate from that of the bottle.

Accordingly, the present invention provides an aesthetically pleasing container based on an ovaloid structure which provides a separate overcap fittable over a bottle without a threaded screw or hinge mechanism.

SUMMARY OF THE INVENTION

The dispensing container of the present invention includes an overcap covering a dispensing aperture. The container allows consumers to easily snap the overcap on and off the bottle. The overcap includes a pintel located within the overcap to seal internally into the dispensing aperture. The pintel is guided into the aperture by a collar as a lead-in feature. Without this lead-in collar, the pintel would easily miss the aperture and cause damage to the soft plastics used in the system.

More particularly, the dispensing container of the present invention includes:

(i) an ovaloid bottle with an open end fitted with a dispensing aperture; and (ii) an ovaloid overcap which has a roof at a closed end thereof and a surrounding wall with a mouth defining an open end opposite the closed end, a pintel and a circular collar both projecting from the roof in a direction toward the open end, the pintel sealingly fittable into the dispensing aperture in a closed position of the container, the collar being within the overcap and surrounding the pintel.

The surrounding wall of the overcap has front and rear faces which are broader in area than side faces.

The collar is intersected by at least one gap. Preferably, there are two gaps, these being placed equidistant from one another along an arc of the collar. When present the two equidistantly spaced gaps are arranged closer to the front and rear faces than those of the side faces.

The mouth of the overcap is defined by a downwardly convex perimeter along the front and rear faces. Moreover, the surrounding wall tapers outwardly from the roof toward the mouth.

An aperture reducing plug is positioned across a dispensing orifice of the bottle and itself forms the dispensing aperture. The plug can either be molded unitarily or formed separately from the bottle. Most preferred is a plug separate from the bottle. This arrangement allows for a wider orifice during filling of the bottle. Once filled, the separate plug can be placed into the orifice opening.

Preferably there are no screw threads along an outer wall of the open mouth. Instead, the overcap operates as a snap-on type closure to seal the bottle. Removal of the overcap is achieved by a twist action utilizing the bottle shoulder as a camming surface for easier removal.

The bottle includes an oval shoulder flaring outwardly in a direction of the closed end. This shoulder operates as the camming surface. An upwardly concave landing is arranged along a lower portion of the oval shoulder. This concave landing mates with the convex perimeter of the overcap when the system is in the sealed closed position.

BRIEF DESCRIPTION OF THE DRAWING

Further features and advantages of the present invention can more fully be appreciated through consideration of the following drawing in which.

DETAILED DESCRIPTION OF THE INVENTION

We have now found a dispensing system for liquids, particularly for cosmetic liquids and especially skin creams and lotions, that has an outward aesthetic appeal and a particularly effective sealing closure. The closure is in the form of an overcap easily removable and readily re-sealable. Another benefit is that the seal is relatively airtight.

Figure 1:
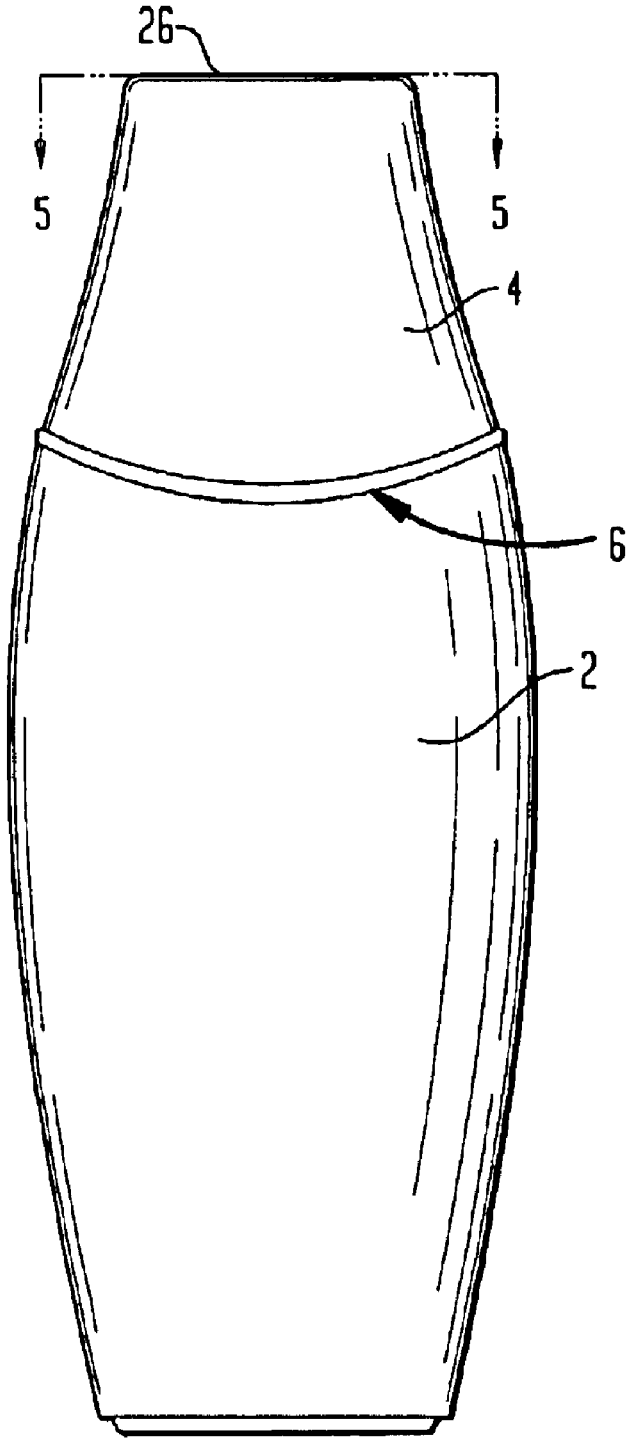
FIG. 1 is a front elevational view of a bottle with overcap according to the present invention.
Figure 3:
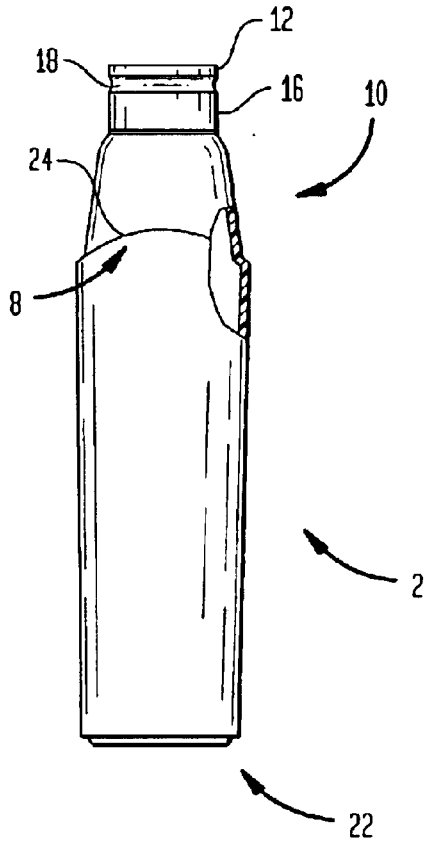
FIG. 3 is a side elevational view of the bottle with overcap removed.

FIG. 1 illustrates an oval dispensing container of the present invention. Fluid product is held in an oval bottle 2 fitted with an overcap 4. Joinder of the overcap and bottle is along a downwardly convex border 6 which may be termed a "smile". The "smile" appears on the front and rear major faces of the container. As shown in FIG. 3, the border on the end faces 8 of the bottle is downwardly concave. This creates a continuously undulating non-straight border around all of the container, and thereby also around the bottle and the overcap.

Figure 2:
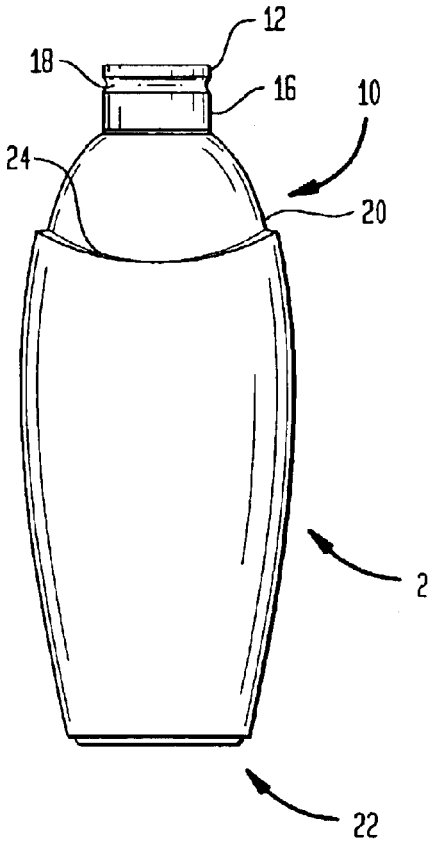
FIG. 2 is a front elevational view of the bottle with overcap removed.
Figure 4A:
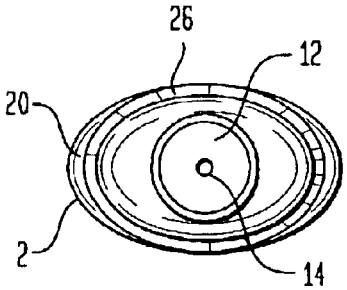
FIG. 4*a* is a top plan view of the bottle as shown in FIG. 2.

FIGS. 2 and 3 best illustrate structures beneath the overcap located on the open end 10 of the oval bottle. A plug 12 is fitted within an orifice at the open end of the bottle. Fluid product is dispensable through a dispensing aperture 14 as best shown in FIG. 4*a*. In the preferred embodiment, the plug 12 is manufactured separate from the unitarily molded bottle. This allows for a larger opening when fluid product is filled into the bottle. Once filled, the plug is inserted into the open orifice within neck 16. This forms a more restrictive diameter thereby controlling product flow when a user squeezes walls of the flexible bottle to dispense the product. In an alternative embodiment, the plug can be molded unitarily with the remainder of the bottle. Advantageously, the aperture is tapered which wilt allow for a tighter seal when mating with closure portions of the overcap.

Figure 4B:
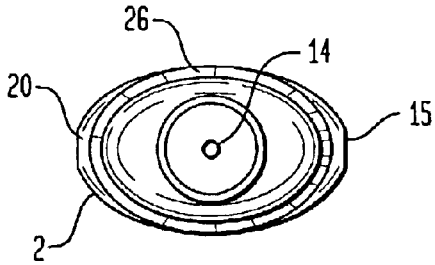
FIG. 4*b* is a top plan view of a second embodiment of a bottle wherein the side faces have no curvature.

FIG. 4*b* illustrates an alternate embodiment of the bottle. Instead of a surface with continuous curvature as traditional for an oval, the side faces 15 are squared-off. Overcaps may also have flat side faces. The second embodiment exemplifies an "ovaloid" cross-section which is other than oval. Although oval cross-section embodiments are preferred, this invention encompasses non-continuous curvatured shapes which have oval characteristics. All of these shapes are within the intended meaning of the "ovaloid" definition.

The preferred embodiment of this invention does not utilize any screw thread mechanism for purposes of closure around the open end of the bottle. However, the preferred embodiment does include an annular groove 18 along the neck just below a top surface of the plug. The groove is a further structure for maintaining the overcap in a tight snap-on relationship over the bottle.

Below the neck 16, the bottle features an oval shoulder 20 flaring outwardly in a direction of a closed end 22 of the bottle. The shoulder terminates at a landing 24 projecting outward from the shoulder all around the bottle. FIG. 2 shows on front and rear faces that the landing is a convex shape facing downwardly toward the closed end of the bottle. Along opposite sides of the bottle flanking the front and rear faces, as best shown in FIG. 3, the landing traces a downwardly concave path relative to the closed end of the bottle.

Figure 5:
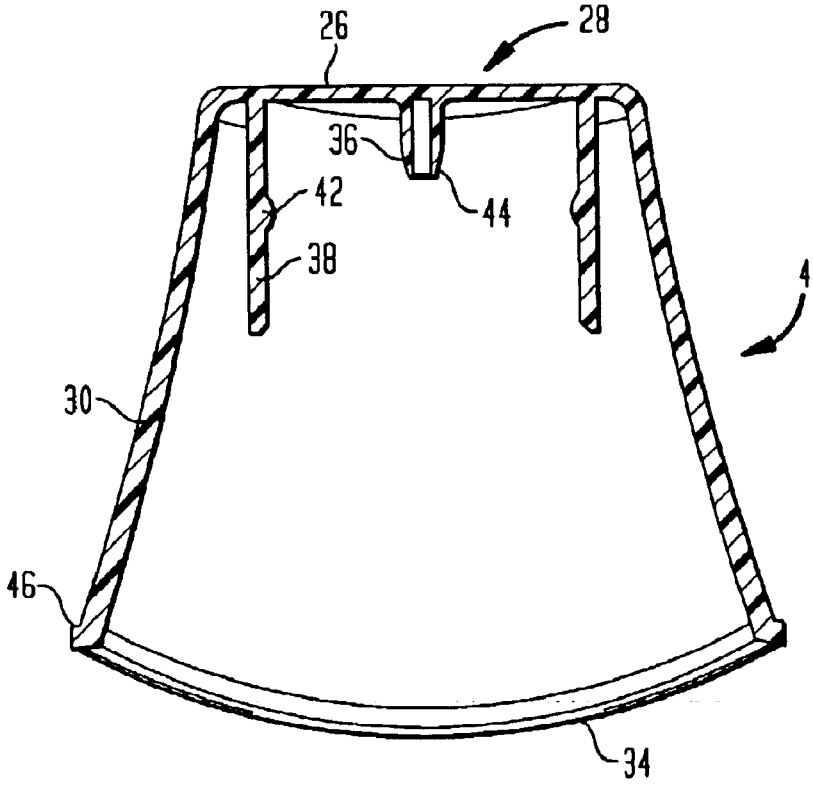
FIG. 5 is a cross-sectional view of the cap taken along line 5—5 of FIG. 1.
Figure 6:
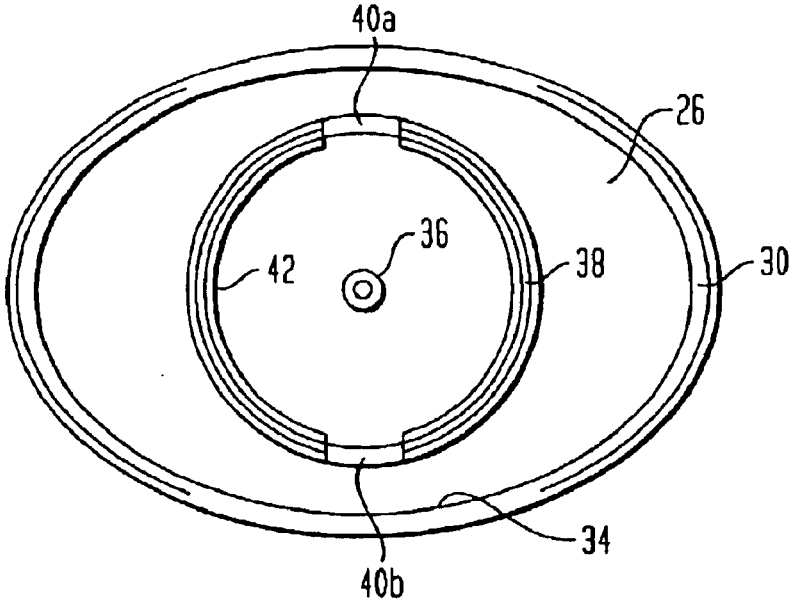
FIG. 6 is an interior view of the cap shown in FIG. 5.

FIG. 5 illustrates the overcap in cross-sectional view. The overcap is formed with a roof 26 at a closed end 28 thereof and a surrounding wall 30. Opposite the roof at an open end of the overcap is a continuously curving mouth 34 along an extremity of the surrounding wall.

A pintel 36 projects downward from the roof in a direction toward the open end of the overcap. A circular (round) collar 38 surrounds the pintel also projecting from the roof of the overcap in a downward direction toward the open end. A pair of gaps 40*a*, 40*b* intersect the collar at points equidistant from one another along the arc of the collar. This results in the collar actually being two hemi-circular structures connected only through their unitary molding with the roof.

A bead 42 is formed along an inner surface of the collar. Pintel 36 at an end distant from the roof features a bevel 44 to facilitate docking with the aperture of the plug.

A noteworthy feature of the overcap is that the surrounding wall tapers outwardly toward the open end. This taper unlike traditional straight tapers has outward curvature. A rim 46 traces the mouth of the overcap and projects slightly outward from the surrounding wall.

A variety of materials of construction can be employed. In the preferred embodiment, high density polyethylene is utilized to fashion the bottle. Low density polyethylene is utilized for the plug. The overcap is formed of polypropylene. However, the invention is not limited to these plastics. Other non-limiting plastic examples include polyester, polyamide, polyvinylchloride and polystyrene as well as terpolymers of a variety of olefins, vinyl chloride and styrenics.

Application of the overcap to the bottle occurs in the following manner. First the overcap with open end downward is aligned over the dispensing end of the bottle. As the overcap descends over the bottle, the collar surrounds the neck to begin the docking sequence. As the overcap further descends, the collar as a result of its segmentation into two arcs moves slightly outward as a top of the neck contacts the bead of the collar. Hand pressure then forces the neck past the bead, with the latter lodging within the groove of the neck. Concurrently, the pintel now aligned by the collar sealingly penetrates the aperture of the plug forming a relatively airtight seat.

Removal of the overcap requires a user to twist the cap while holding the bottle. Leverage for removal of the pintel and disengagement of groove/bead is achieved through a camming motion along the shoulder of the bottle as twisting proceeds. Thus, the camming removes the overcap in a twist manner instead of the more traditional extraction of pintel from aperture through being pulled straight upward.

The term "comprising" is meant not to be limiting to any subsequently stated elements but rather to encompass non-specified elements of major or minor functional importance. In other words the listed steps, elements or options need not be exhaustive. Whenever the words "including" or "having" are used, these terms are meant to be equivalent to "comprising" as defined above.

What is claimed is:

1. A dispensing container comprising:

(i) an ovaloid bottle with an open end fitted with a dispensing aperture, the bottle comprising an oval shoulder flaring outwardly in a direction toward a closed end of the bottle, the oval shoulder meeting a continuously curved landing; and (ii) an ovaloid overcap comprising a roof at a closed end thereof and a surrounding wall with a mouth defining an open end opposite the closed end, a pintel and a circular collar both projecting from the roof in a direction toward the open end, the pintel sealingly fittable into the dispensing aperture in a closed position of the container, the collar being within the overcap and surrounding the pintel.

2. The container according to claim 1 wherein the collar is intersected by at least one gap.

3. The container according to claim 2 wherein the collar is intersected by two gaps, the gaps being placed equidistant from one another along an arc of the collar.

4. The container according to claim 3 wherein the surrounding wall comprises front and rear faces broader in area than side faces and the gaps are adjacent the front and rear faces.

5. The container according to claim 1 wherein the surrounding wall comprises front and rear faces and the mouth of the overcap is defined by an outwardly convex perimeter along the front and rear faces.

6. The container according to claim 1 wherein the surrounding wall tapers outwardly toward the mouth.

7. The container according to claim 1 wherein the dispensing aperture is formed in a plug unitarily molded with the bottle.

8. The container according to claim 1 wherein the dispensing aperture is formed in a plug, the plug being constructed separately from the bottle.

9. The container according to claim 1 wherein the bottle has no screw threads for purposes of closure.

* * * * *